US007712554B2

(12) United States Patent
Gien

(10) Patent No.: US 7,712,554 B2
(45) Date of Patent: May 11, 2010

(54) PERCUSSIVE DRILL BIT PROVIDED WITH AN IMPROVED CHUCK ASSEMBLY

(76) Inventor: Bernard Lionel Gien, Nos. 2 & 4 Simba Street, Sebenza, Edenvale 1610, Gauteng Province (ZA)

( * ) Notice: Subject to any disclaimer, the term of this patent is extended or adjusted under 35 U.S.C. 154(b) by 203 days.

(21) Appl. No.: 11/466,187

(22) Filed: Aug. 22, 2006

(65) Prior Publication Data

US 2007/0045009 A1 Mar. 1, 2007

(30) Foreign Application Priority Data

Aug. 25, 2005 (ZA) ..... 2005/06810

(51) Int. Cl.
*E21B 10/38* (2006.01)

(52) U.S. Cl. ..... 175/417; 175/296; 173/130; 173/132; 173/133

(58) Field of Classification Search ..... 175/293, 175/296, 414, 417; 173/133, 130, 132; 279/19
See application file for complete search history.

(56) References Cited

U.S. PATENT DOCUMENTS 2,661,928 A * 12/1953 Topanelian, Jr. ..... 173/73
2,947,519 A * 8/1960 Feucht ..... 173/73
3,065,805 A * 11/1962 Martini ..... 175/56
3,379,261 A * 4/1968 Martini ..... 173/64
3,735,820 A * 5/1973 Curington ..... 173/78
5,647,447 A * 7/1997 Jones ..... 175/300
6,698,537 B2 * 3/2004 Pascale et al. ..... 175/300

* cited by examiner

*Primary Examiner*—Jennifer H Gay
*Assistant Examiner*—Robert E Fuller
(74) *Attorney, Agent, or Firm*—J. Harold Nissen; Lackenbach Siegel, LLP

(57) ABSTRACT

A percussive drill bit provided with an improved chuck assembly for a down-the-hole drill hammer. The bit has a head at its forward end with a shank extending from the head. The shank is screw threaded along its length. A reciprocating chuck is provided as a sleeve with internal screw thread as corresponding to those of the shank. The shank is releasably secured in the chuck with the read end of the shank providing a striking face. An arrangement of external splines on the chuck, and a retaining shoulder at its rear end, provide for the required guided movement of the chuck within a drill hammer wear sleeve.

12 Claims, 5 Drawing Sheets

PERCUSSIVE DRILL BIT PROVIDED WITH AN IMPROVED CHUCK ASSEMBLY

FIELD OF THE INVENTION

The invention relates to a drill bit and more particularly to a percussive drill bit with an improved chuck assembly for a down-the-hole drill hammer.

BACKGROUND TO THE INVENTION

Drill bits of this kind conventionally have a shank which fits inside the drill housing and an exposed head at the forward end. The head is provided with teeth on a drilling face at its working end. The shank has splines which are engaged by corresponding splines in a chuck secured in the drill hammer. The rear end of the bit shank forms a striking face onto which a reciprocating piston hammer impacts during operation. Between the striking face and the splines, is a section of reduced diameter. This section defines a pair of shoulders between which a retaining ring, normally above the chuck, slidably engages the bit. The section of reduced diameter has to be longer than the axial thickness of the retaining ring. This allows for the necessary axial or longitudinal movement of the bit.

The drill hammers operate with different air flow paths which sometimes require the bit to include a foot valve tube. There is however a tendency towards drill hammers with bits that do not require these tubes.

The features required on a bit make this component a difficult one to machine. They also dictate that it must be of a certain minimum length which affects its weight and the overall length of the drill hammer. A drill hammer will ordinarily use about five bits during the course of its life.

OBJECT OF THE INVENTION

It is an object of the current invention to provide a drill bit that is simpler and easier to manufacture.

SUMMARY OF THE INVENTION

In accordance with this invention there is provided a drill bit for a down-the-hole drill hammer comprising a head with a shank adapted to be releasably secured in a reciprocating chuck.

The invention further provides for the rear end of the shank to provide a striking face; for the shank to be screw threaded along its length; and for the chuck to be externally splined with an outwardly extending shoulder at or near its rear end.

BRIEF DESCRIPTION OF THE DRAWINGS

These and other features of the invention will be further described, by way of example only, with reference to the accompanying drawings, wherein.

DETAILED DESCRIPTION OF THE INVENTION

Figure 1:
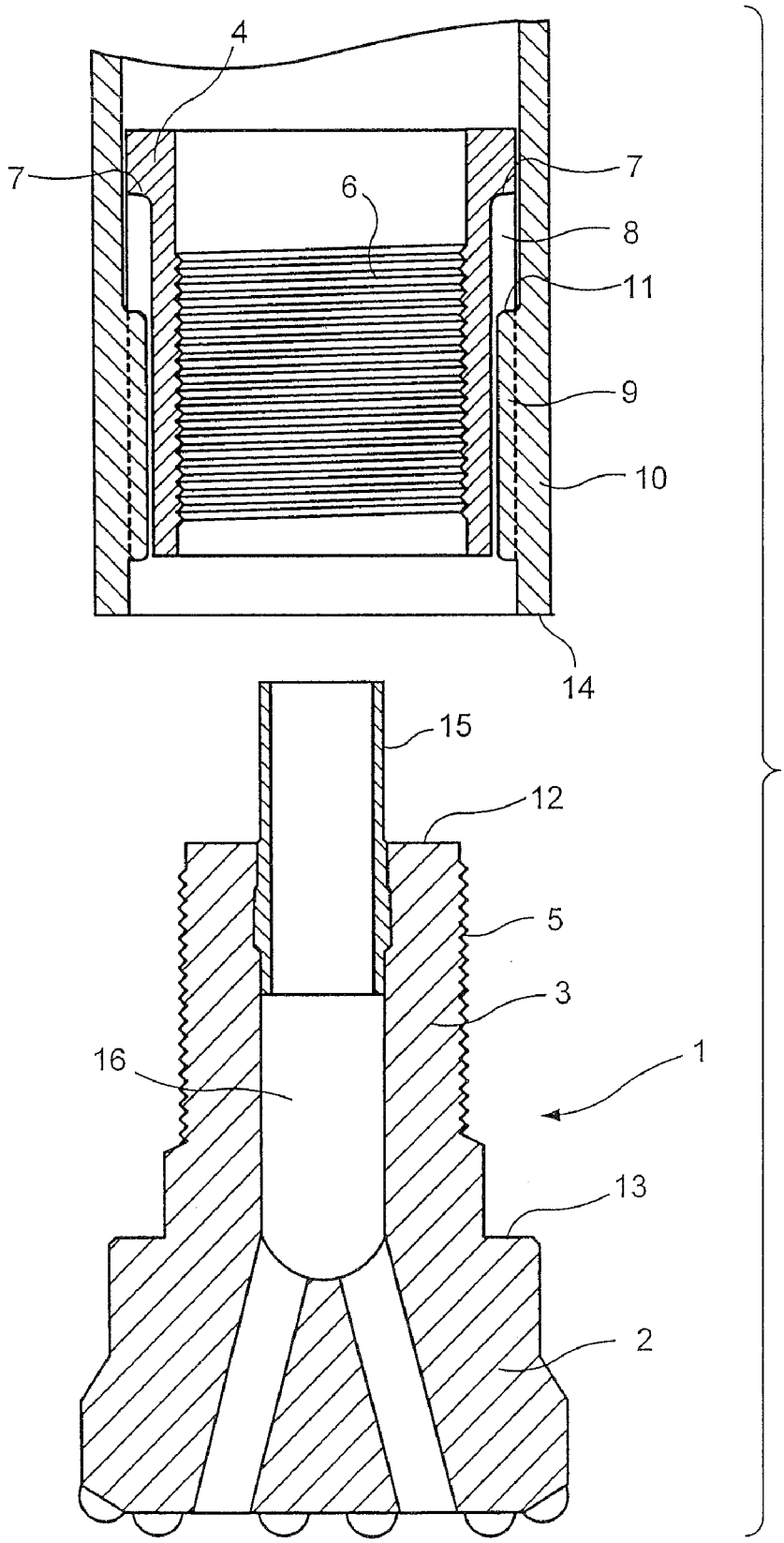
FIG. 1: shows a cross-sectional side view of one embodiment of a drill bit with a foot valve tube.

Referring to FIG. 1, a drill bit (1) is shown having a head (2) at its forward end. Extending from the head (2) is a shank (3) which is adapted to be releasably secured in a reciprocating chuck (4). The shank (3) has screw threads (5) along its length. The chuck (4) is provided as a sleeve, with corresponding screw threads (6) along its inside adjacent its forward end.

An outwardly or laterally extending shoulder (7) is provided at the rear end of the chuck (4). The exterior of the chuck (4) from the shoulder (7) to its forward end is splined with the shoulder (7) formed between the splines (8). The splines (8) of the chuck (4) engage in corresponding splines (9) in the wear sleeve or housing (10) of a drill hammer. The rear end of each of the splines (9) provides a shoulder (11) to retain the chuck (4) in the wear sleeve (10).

When the drill hammer is assembled, the chuck (4) is inserted from the rear of the wear sleeve (10). The chuck (4) slides forward and once the splines (8) and (9) mesh, the shoulder (7) of the chuck (4) will abut the shoulders (11) in the wear sleeve (10). The remainder of the drill hammer components are then fitted to complete the assembly.

The drill bit (1) can then be fitted by screwing it into fixed engagement with the chuck (4). The chuck (4) is thus secured around the shank (3) which provides, at its rear end, a striking face (12) for the bit (1).

During operation of the drill, the shoulders (7) and (11) limit the forward stroke of the bit (1) when the striking face (12) at its rear end is impacted by the piston hammer (not shown). The shoulder (13) provided around the rear of the head (2) will stop against the forward end (14) of the wear sleeve (10) when the bit (1) is lifted.

Figure 2:
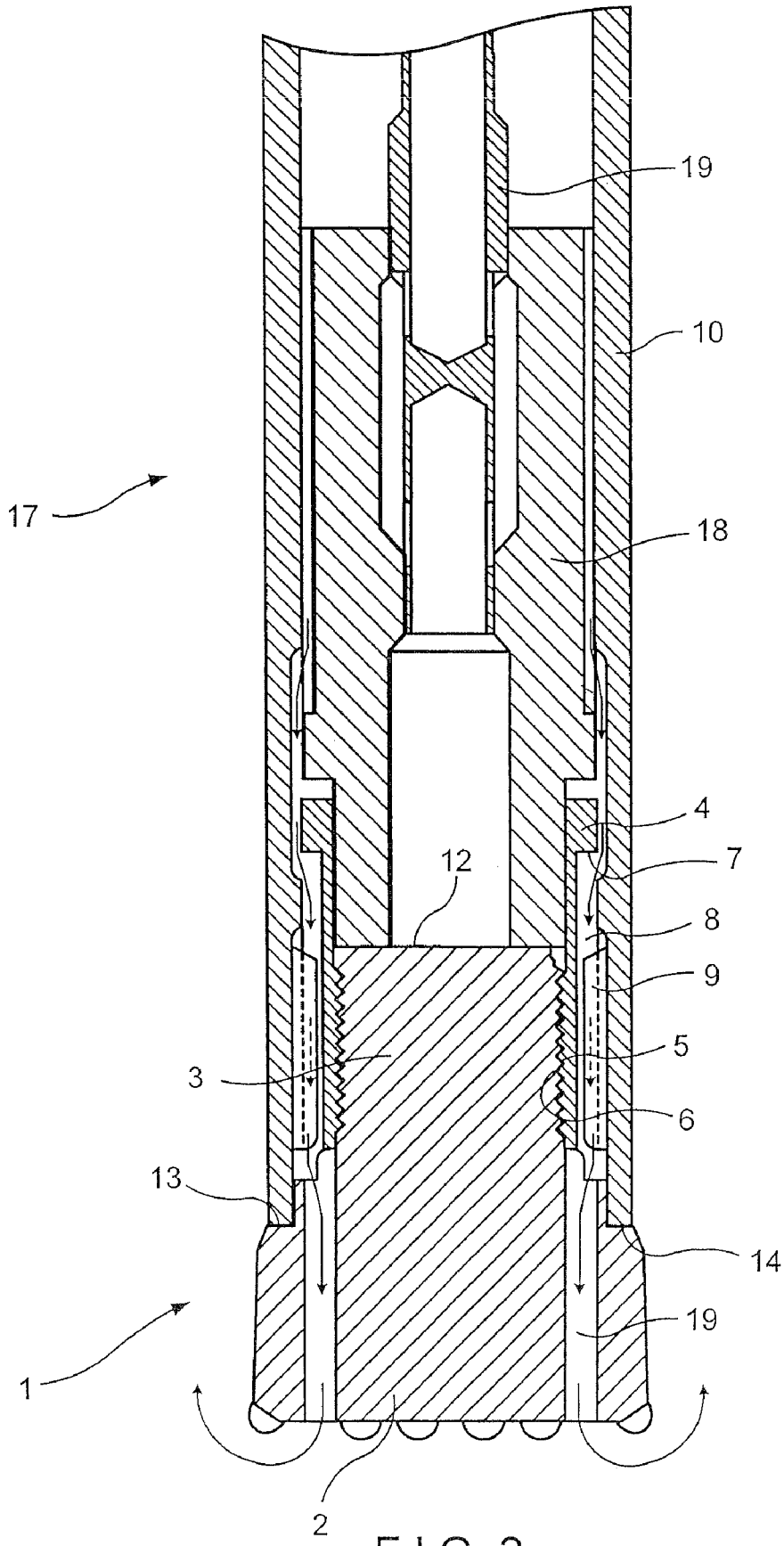
FIG. 2: shows a cross-sectional side view of another embodiment of a bit in a drill hammer.
Figure 3:
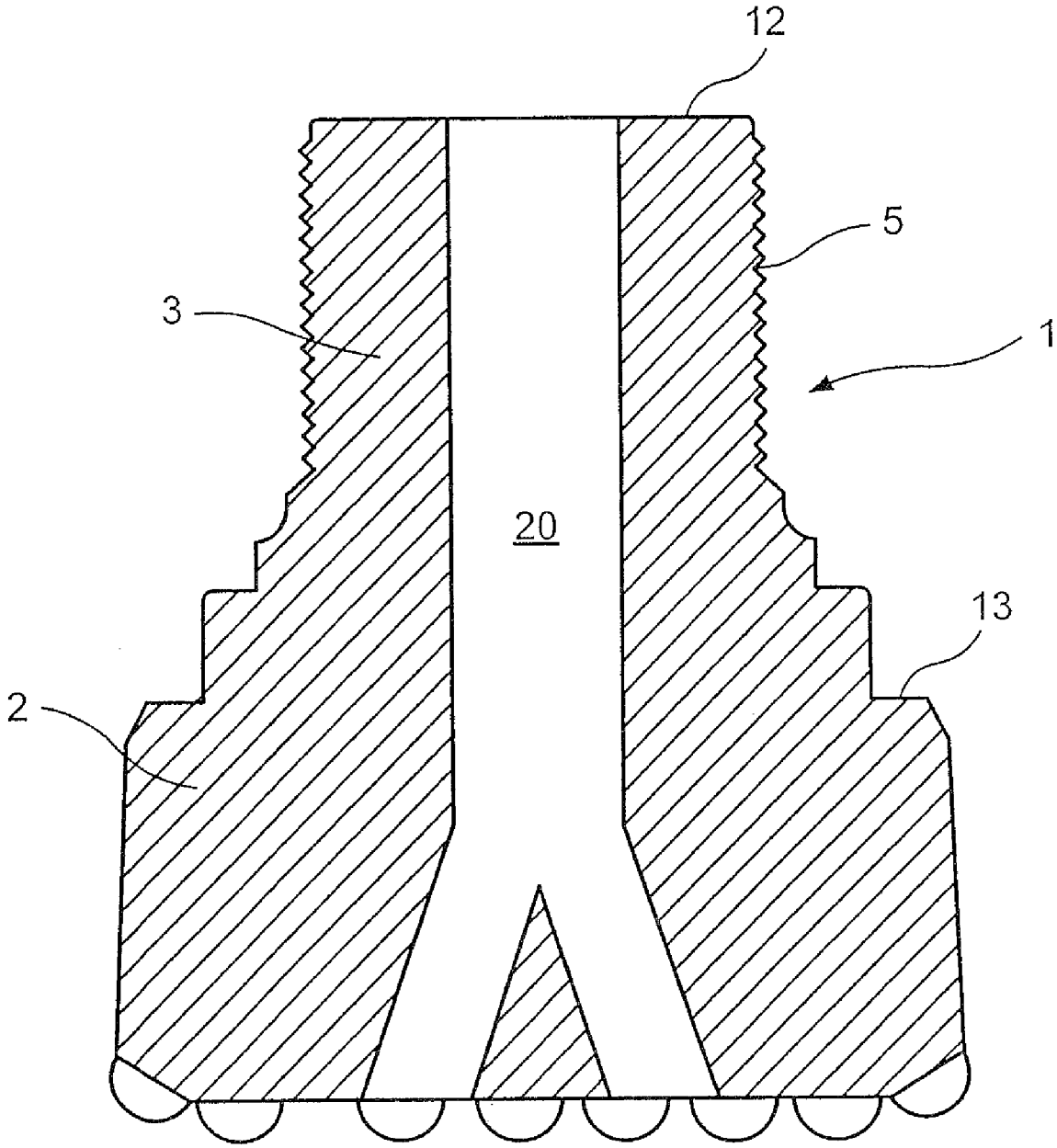
FIG. 3: shows still another embodiment of a bit without a foot valve tube.

This embodiment of the drill bit (1) has a foot valve tube (15) and axial exhaust passage (16) which opens through the drilling face of the head (2). Two further embodiments of the drill bit (1), which do not have such a tube, are shown in FIGS. 2 and 3 respectively. The same reference numerals from FIG. 1 are used for corresponding components in the other two figures.

The drill bit (1) of FIG. 2 is provided in a drill hammer (17) based on the disclosures of my South African Patent Number 2004/2256. That specification sets out the airflow paths of the operation cycle in some detail. That detail will not be repeated here.

The bit (1) and chuck (4) are shown in a lifted or rearward position, with the shoulder (13) on the head (2) against the forward end (14) of the wear sleeve (10). The piston (18) reciprocates under influence of pressurized air which comes down the control rod or air distributor (19). The forward end of the piston (18) is slidably received in the annular chuck (4) provided around the striking face (12). In this embodiment the chuck (4) thus operates as a piston stem bush from which the forward portion of the piston (18) is lifted to exhaust the lower chamber.

The exhaust paths from the upper and lower chambers at either end of the piston (18) are around the rear end and shoulder (7) of the chuck (4) past the splines (8) and (9) along the outside of the bit (1) and through passages (19) in the head (2).

In FIG. 3 another bit (1) is provided to operate with an embodiment of the drill hammer in FIG. 2 wherein the exhaust takes place through the centre of the bit (1), via passage (20). A chuck suitable for a particular drill hammer of this type will be within the design competence of a person skilled in the art.

Figure 4:
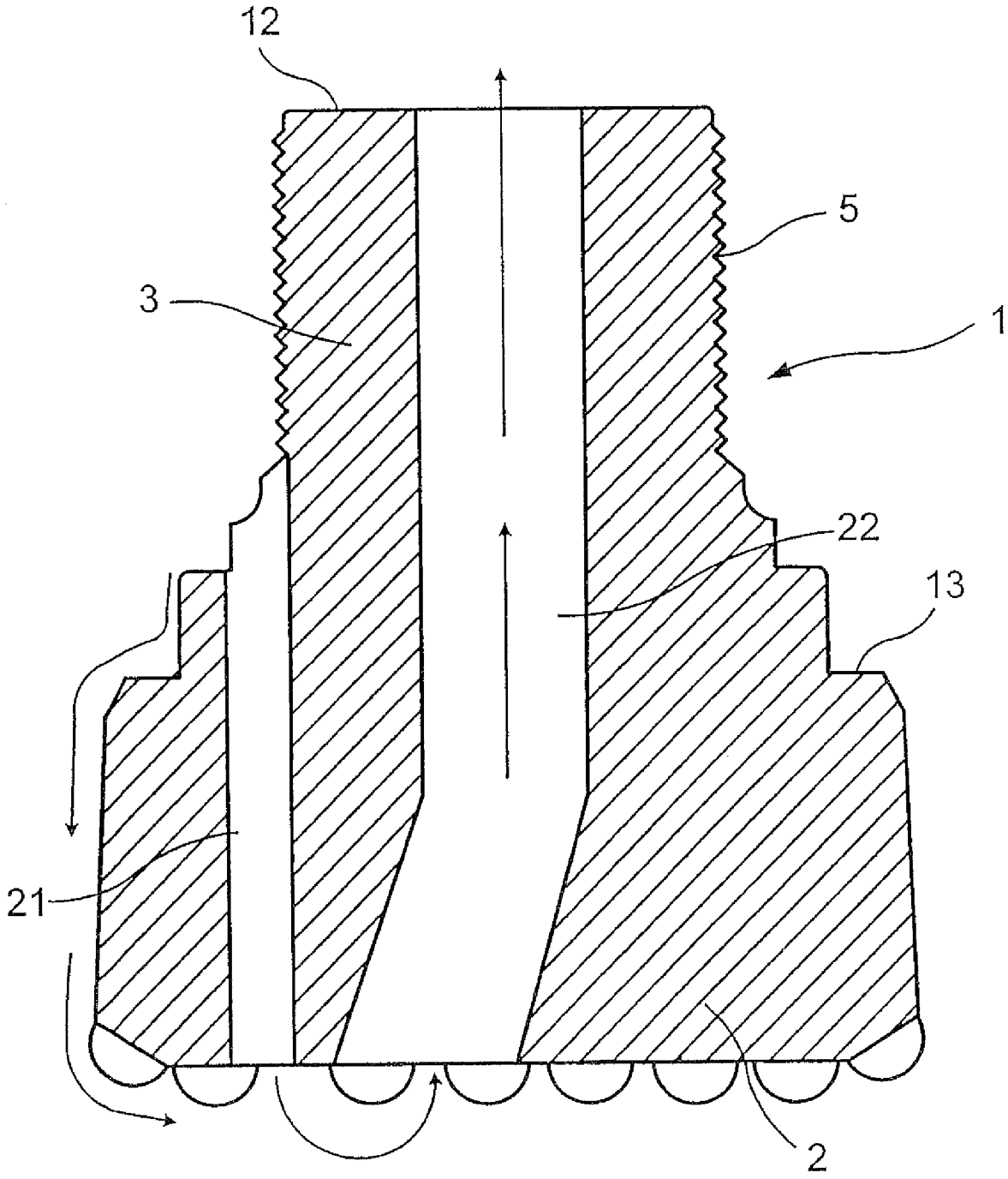
FIG. 4: shows yet another embodiment of a drill bit.

FIG. 4 shows another embodiment of a drill bit (1) in accordance with this invention but for use with a reverse circulation drill hammer (not shown). In such a hammer, the exhaust air travels around the outside of the head (2) and through passage (21) to the bottom of the hole. The drilled cuttings are then entrained in the flow of air upwardly through bore (22). The bore (22) communicates with through the drill hammer to a passage extending through the centre of dual rods (not shown) to the surface. This flow of exhaust air is indicated by the arrows in FIG. 4. Again, a suitable chuck will be within the design competence of a person skilled in the art.

Figure 5:
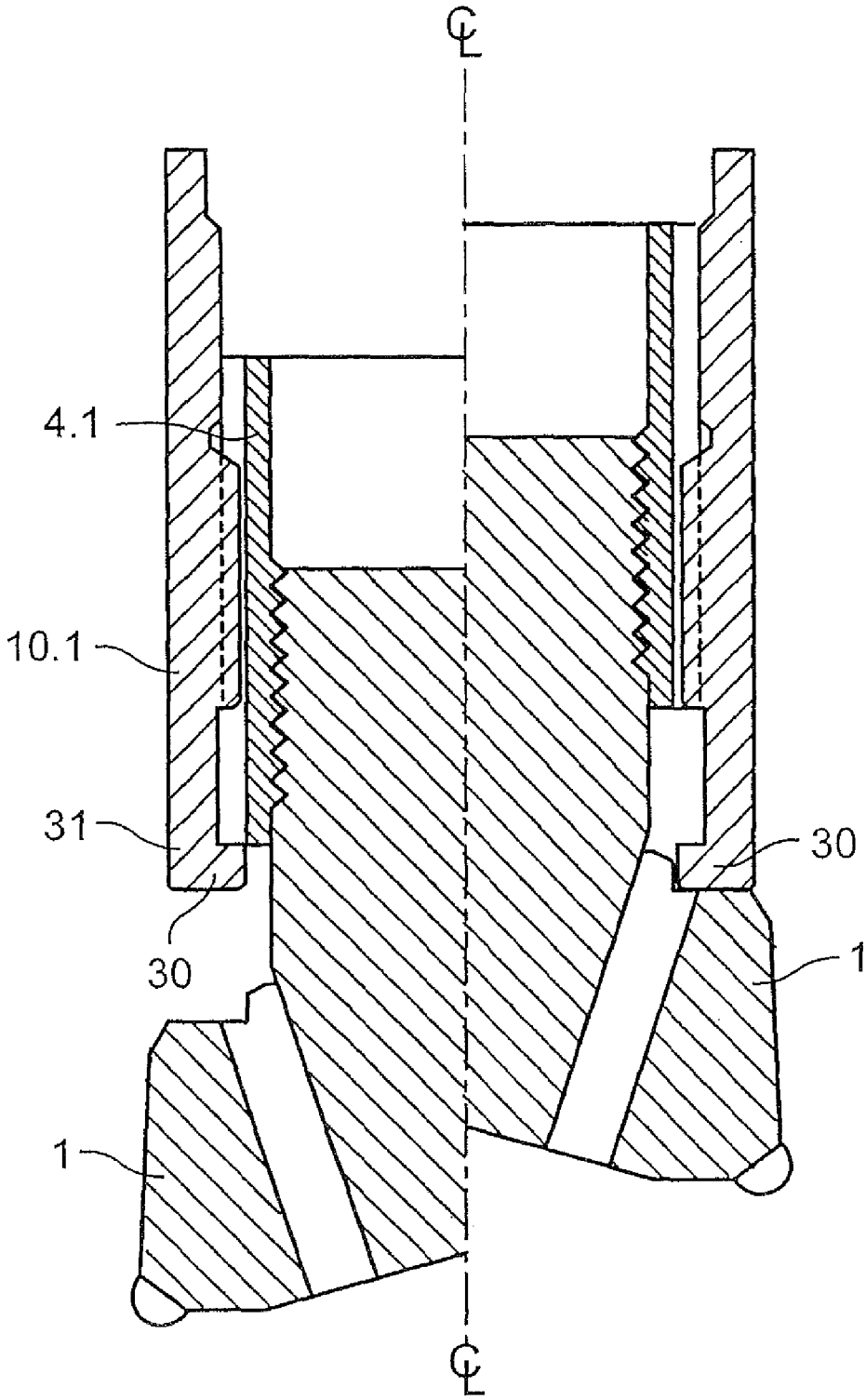
FIG. 5: shows another embodiment of a chuck and wear sleeve.

It will be readily appreciated that the chuck (4.1) need not have an outwardly extending shoulder as illustrated in FIG. 1. The chuck (4.1) illustrated in FIG. 5 is splined thoughout its entire length. The wear sleeve (10.1) has an inward lip (30) formed at its rear end (31) to retain the chuck (4.1) thereinside.

The invention provides a bit which can be used on most, if not all, types of down the hole drill hammers and which is simpler to machine. Screw threads replace the usual splines and other structural features ordinarily required. These are then provided in the more expensive parts of a drill hammer, namely the reciprocating chuck and wear sleeve. The conventional retaining ring is also not required in the embodiments shown.

A person skilled in the art will appreciate that the limited sliding fit between the chuck and the wear sleeve can be achieved through means other than splines.

The invention claimed is:

1. A down-the-hole hammer drill including an improved drill bit and chuck assembly, the hammer drill comprising:

a wear sleeve or housing having a rear end and an opposed forward end and having a reciprocable piston received therein, the reciprocable piston having an impact end;

a chuck received within the forward end of the wear sleeve or housing, the chuck being adapted for insertion into the wear sleeve or housing via the rear end thereof, the chuck being externally splined and the wear sleeve or housing being internally splined, the splines of the chuck and the wear sleeve or housing engaging to enable reciprocal motion of the chuck within the wear sleeve or housing;

a drill bit having a head at its forward end and a shank extending from the head, the shank defining a striking face at its free end and the drill bit being threadedly received within the chuck such that the striking face of the drill bit is in opposed striking relationship with the impact end of the piston; wherein the drill hammer further comprises means for retaining the chuck within the wear sleeve or housing when the impact end of the piston impacts onto striking face of the drill bit, in use; and the impact end of the piston being adapted to impact onto the striking face of the drill bit without impacting the chuck.

2. The down-the-hole hammer drill as claimed in claim 1 in which the shank is screw threaded along its length.

3. The down-the-hole hammer drill as claimed in claim 1 in which said chuck is provided with screw threads adjacent the forward end of said chuck, a rear end of said chuck thereby providing a guide for the impact end of the piston.

4. The down-the-hole hammer drill as claimed in claim 3 in which the screw threads do not extend the entire length of said chuck.

5. The down-the-hole hammer drill as claimed in claim 3 in which said striking face of said shank provides for a direct striking area between said striking face and said reciprocable piston.

6. The down-the-hole hammer drill as claimed in claim 1 in which the means for retaining are provided on said chuck and said wear sleeve or housing.

7. The down-the-hole drill hammer as claimed in claim 6 in which said means for retaining comprises said chuck having an outwardly extending shoulder at its rear end, and rear ends of the splines of the wear sleeve or housing provide an inwardly extending shoulder.

8. The down-the-hole hammer drill as claimed in claim 6 in which said means for retaining includes an inwardly projecting lip on said wear sleeve or housing and said chuck includes means at said forward end, engageable with said lip.

9. The down-the-hole hammer drill as claimed in claim 8 in which said inwardly projecting lip is provided at the forward end of said wear sleeve or housing for the engagement with the means at the forward end of said chuck.

10. The down-the-hole hammer drill as claimed in claim 1, wherein the chuck has an outwardly extending shoulder at its rear end, and rear ends of the splines of the wear sleeve or housing provide an inwardly extending shoulder, the outwardly extending shoulder of the chuck and the outwardly extending shoulder of the wear sleeve or housing engaging to provide means for retaining the chuck within the wear sleeve or housing when the impact end of the reciprocable piston impacts onto the striking face of the drill bit, in use.

11. The down-the-hole drill hammer as claimed in claim 1, wherein the wear sleeve or housing has an inwardly facing lip at its forward end, the lip and forward ends of the splines of the chuck engaging to provide means for retaining the chuck within the wear sleeve or housing when the impact end of the reciprocable piston impacts onto the striking face of the drill bit, in use.

12. The down-the-hole drill hammer as claimed in claim 1, wherein the striking face of the shank is recessed with respect to the rear end of the chuck and the chuck is thereby provided with an annular piston stem bush into which the forward end of the piston is slidably receivable.

* * * * *